United States Patent [19]

Relder

[11] Patent Number: 4,799,911

[45] Date of Patent: Jan. 24, 1989

[54] IMAGE INTENSIFIER TUBE WITH INTEGRAL CCD DIGITAL READOUT

[75] Inventor: Edward J. Relder, Garland, Tex.

[73] Assignee: Varo, Inc., Garland, Tex.

[21] Appl. No.: 72,684

[22] Filed: Jul. 13, 1987

[51] Int. Cl.[4] ..... H01J 9/12; H01J 9/26

[52] U.S. Cl. ..... 445/14; 445/35; 445/45; 445/70

[58] Field of Search ..... 445/44, 43, 14, 23, 445/35, 45, 70

[56] References Cited

U.S. PATENT DOCUMENTS

| | | | |
|---|---|---|---|
| 3,026,163 | 3/1962 | Day | 445/35 |
| 3,334,955 | 8/1967 | Day | 445/44 |
| 3,630,590 | 12/1971 | Strubig et al. | 445/44 |
| 4,166,563 | 9/1979 | Peyraud et al. | 445/70 X |
| 4,186,980 | 2/1980 | Wolski | 445/23 |

*Primary Examiner*—Kenneth J. Ramsey
*Attorney, Agent, or Firm*—Jerry W. Mills; Alan W. Lintel

[57] ABSTRACT

A CCD (12) or other photoelectronic device is bonded to an image tube housing (26) to provide a digital output from the image tube (19). The housing (26) and cathode (19) are degassed in chambers (44 and 42) at a high temperature and low pressure. A load lock chamber (46) is degassed and evacuated to remove contaminants. After cooling the chambers (42, 44 and 46) the CCD (12) is placed in the load lock chamber (46) which is then sealed and evacuated. After evacuation, a gate valve (54) is opened between the load lock chamber and the housing chamber (44) and the CCD is placed on a press station (63) of a metal bellow (64). The metal bellow (64) is extended to push the CCD (12) against an indium seal ring (36) on the housing (26), creating a seal between the CCD (12) and the housing (26).

24 Claims, 1 Drawing Sheet

IMAGE INTENSIFIER TUBE WITH INTEGRAL CCD DIGITAL READOUT

TECHNICAL FIELD OF THE INVENTION

This invention pertains in general to image intensifying tubes, and more particularly to an image intensifying tube with an integral digital photoelectronic readout.

BACKGROUND OF THE INVENTION

Image tubes are electro-optical devices that are used to detect, intensify, and shutter optical images in the near ultraviolet, visible, near infrared, X-ray and gamma-ray regions of the electro-magnetic spectrum. They are used extensively for night vision, astronomy, X-ray and gamma-ray intensification, electron microscopy, medical research, radiology, and as high speed light shutters. Basically, an image intensifier tube comprises a photocathode for the conversion of the incident radiant image to a low energy electron image, an electron lens for the production of a high energy electron image, and a phosphor screen for the conversion of the high energy electron image to a light image. The photon gain of the image intensifier tubes may range from less than unity to several million, depending on the incident radiation wave length and the number of the tube stages.

In many applications, remote monitoring of the output of the photocathode is desirable. Although the visual image from the phosphor screen may be transmitted to a remote location using fiber optics, the quality and resolution of the image decays as a result of its propagation through fiber optic elements. Hence, a digital output of the image transmitted from the photocathode is preferable, since it may be transmitted along an electrical conductor without denigration.

Several types of digital photoelectronic devices are capable of digitizing the output of the photocathode, including charge coupled devices (CCDs), charge injected devices (CIDs) and MOS photodiode arrays. However, previous attempts to mate the digital devices with the photocathode have been inadequate for many applications.

In one previously proposed device, the image tube is fabricated with a short fiber optic lead connected to the phosphor screen. A CCD or other digital device may be optically bonded to the other end of the fiber optic lead to produce a digital output. However, this system suffers from limited resolution, linear and shear distortion due to the fiber optics, and light losses due to optic coupling and phosphor efficiency. Furthermore, this system does not overcome any of the disadvantages associated with phosphor screens, such as problems associated with the decay time of phosphor and color matching the color of the phosphor screen to the spectral sensitivity of the digital device.

Another attempt at mating a digital device with the image tube has comprised replacing the phosphor screen with the digital device itself. However, since vacuum photo tubes undergo a twelve-hour bake-out process at 375° C., the digital devices are damaged as a result of the fabrication process of the image tube The most successful attempts at producing a system of this type known to applicant have resulted in image tubes with lifetimes on the order of a only few days.

Thus, a need has arisen for a image tube with direct coupling between the photocathode and the digital device, which overcomes the high temperature limitations of the fabrication process.

SUMMARY OF THE INVENTION

The present invention disclosed and claimed herein describes a method and apparatus for creating a seal between a CCD, or other photoelectronic device, and an image tube housing which substantially eliminates problems associated with prior attempts to directly integrate a CCD and image tube.

In one embodiment of the invention, the image tube housing is processed in a first chamber wherein the housing is degassed by heating the first chamber at 375° C. for twelve hours at $10^{-9}$ torr. A second chamber is similarly heated and evacuated to remove all undesirable particles therein. After cooling, a CCD is placed in the second chamber which is thereafter evacuated to a pressure substantially equal to the pressure in the first chamber. A gate valve between chambers opens to allow a seal to be formed between the image tube housing and the CCD at room temperature.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
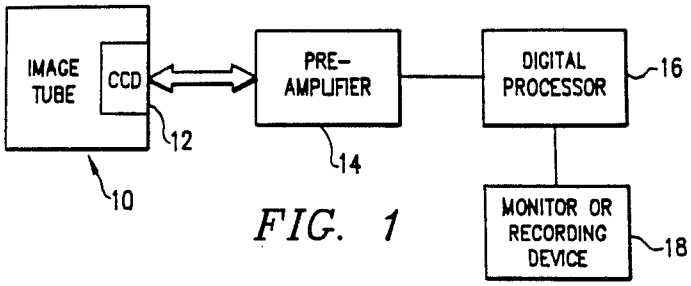
FIG. 1 illustrates a block diagram for remote monitoring of an image tube output.
Figure 2:
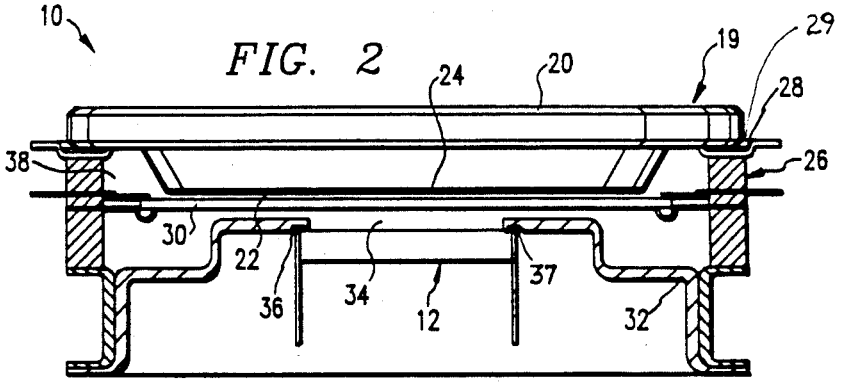
FIG. 2 illustrates a cross sectional diagram of an image tube in accordance with the present invention using a CCD or other photoelectronic device in place of a phosphor screen.
Figure 3:
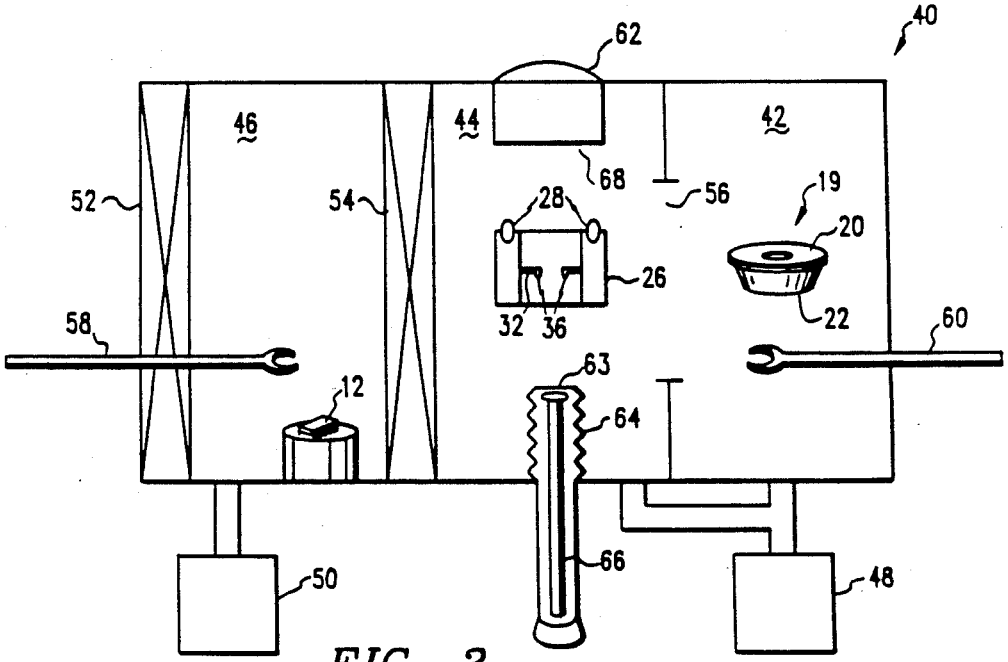
FIG. 3 illustrates a vacuum chamber apparatus used to fabricate the image tube of FIG. 2.

The preferred embodiment of the present invention is best understood by referring to FIGS. 1–3 of the drawings, like numerals being used for like and corresponding parts of the various drawings.

FIG. 1 illustrates a block diagram of a circuit used for remote monitoring of the output of an image tube. An image tube 10, having a CCD or other photoelectronic device 12 (hereinafter CCD 12), is connected to a preamplifier 14. The output of the preamplifier 14 is connected to a digital processor 16. The output of the digital processor 16 is connected to a monitor or recording device 18 to enable remote viewing of images detected by tube 10.

Generally, the image tube 10 comprises an image sensor which converts an incident gradient image to a low-energy electron image, an electron lens which amplifies the low-energy electron image to a high-energy electron image, and an output device for the conversion of the high-energy electron image into a light image or a electronic representation thereof. The image tube may be a single stage tube or a multistage tube comprising of multiple single stage tubes in cascade. The image tube 10 is described in detail in connection with FIG. 2.

In the preferred embodiment, the output device comprises the CCD 12 or another type of digital photoelectronic display such as a charge injected device or a MOS photodiode array. Such devices are available in various configurations, such as a $1\times1024$ array. The choice of the CCD 12 or other digital photoelectronic display will depend upon the application for which the image tube 10 is designed.

The output of the CCD 12 is received by a preamplifier 14 which boosts the output of the CCD 12 to a suitable voltage level The amplified signal from the CCD 12 is then received by the digital processor 16 which translates the output of the CCD 12 into a form which can be used by a video monitor. In an alternative embodiment, the digital processor translates the amplified output signal into a form suitable for later analysis.

In the illustrated embodiment, a monitor 18 is used to display the output of the digital processor 16. In an alternative embodiment, a recorder or digital storage device may be used to receive the output from the digital processor 16.

Referring now to FIG. 2, a cross-sectional view of the image tube of the present invention is illustrated. A cathode assembly 19 comprises an optic input or faceplate 20 having a photocathode 22 with an evaporated coating 24. The faceplate 20 and photocathode 22 are connected to a housing 26 by an indium seal 28 disposed in a trough 29. Below the photocathode is an microchannel plate 30. A frame 32 is connected to the housing 26. The frame provides a window 34 upon which the CCD 12 is mounted using a second indium seal 36 in a second trough 37. A vacuum exists in the cavity 38 formed by the housing 26, faceplate 20, frame 32 and CCD 12. Alternate embodiments of an image intensifier tube are discussed in *Image Tubes*, by Illes P. Csorba, Howard W. Sams & Co., Inc. (1985), which is incorporated by reference herein.

The indium seals are formed by first melting indium in the troughs 29 and 37. Sufficient indium should be used such that the indium extends beyond the edges of the troughs 29 and 37. The indium is allowed to solidify at room temperature. The cathode assembly 19 is placed on the indium seal 28 and the CCD 12 is placed on the indium seal 36. As pressure is applied to the cathode assembly 19 and CCD 12, airtight seals are formed.

In order to maintain a vacuum in the cavity 38, its principal parts need to be "degassed." To accomplish the degassing, the parts are baked for twelve hours at 375° C. in an ultra-high vacuum chamber Typically, the baking process is performed at a pressure on the order of $10^{-9}$ torr. After baking, the image tube 10 must be assembled in the evacuated chamber.

Prior attempts at directly interfacing the CCD 12 with the photocathode 22 have failed because the CCD 12 could not survive the baking-out process. FIG. 3 illustrates an apparatus for fabricating a image tube with an internal CCD without damaging the CCD during manufacturing. A three-chamber vacuum system 40 has cathode processing chamber 42, a tube processing chamber 44 and a load lock chamber 46. An ion pump 48 is used to evacuate the tube processing chamber 44 and the load lock chamber 46. Another pump 50 is used to evacuate the load lock chamber 46. The load lock chamber 46 is separated from the outside by a valve 52, and is separated from the tube processing chamber 44 by a gate valve 54. The tube processing chamber 44 and the cathode processing chamber 42 are connected through a aperture 56. Manipulators 58 and 60 are used to transport materials between chambers. Sight glass 62 allows the operator to observe the inside of the tube processor chamber 44. A press station 63 disposed on the top of metal bellows 64 and jack 66 provides a vertically moving platform below the tube housing 26. A press 68 is placed on the top wall of the chamber 44.

In a first step of the process of the present invention, the cathode assembly 19 is placed in the cathode processing chamber 42 and the housing 26 is placed in the tube processing chamber 44. Suitable platforms are provided for holding the cathode assembly 19 and housing 26 in their respective chambers The load lock chamber 46 remains empty during this stage.

The three chambers are each pumped down to about $10^{-9}$ torr. Preferably, ion pumps 48 and 50 are used to evacuate the chambers, such that no organic oils, solvents, gaskets, or other organic material are released into the evacuated chambers. After the desired pressure is reached, all three chambers 42, 44 and 46, are heated to approximately 375° C. in a "degassing" process. The degassing process removes hydrogen, nitrogen and water vapor from the chambers 42, 44, and 46 and from the housing 26 and cathode assembly 19. These gases would otherwise slowly leak out and destroy the vacuum in the cavity 38.

After the bake-out process, the pressure in the chambers is reduced to approximately $10^{-6}$ torr and the temperature is allowed to decrease to approximately 200° C. The photocathode 22 is formed on the cathode assembly 19 by evaporating alkaline material in the cathode processing chamber 42. As shown in the illustrated embodiment, a separate chamber is preferably used to process the cathode assembly 19 to contain the alkali material. Other types of photocathodes may be processed on the cathode assembly 19 using other methods, as would be known by those skilled in the art.

In a next step, the chambers 42, 44 and 46 are allowed to cool to room temperature or to another temperature at which the CCD 12 will not be damaged. The temperature should be below 200° C. to prevent damage to the CCD 12. After the desired temperature has been reached, gate valve 54 is closed and valve 52 is opened allowing access to the load lock chamber 46 from the outside. The CCD 12 is placed on a suitable platform in the load lock chamber 46 and valve 52 is closed. The load lock chamber is then evacuated to a pressure of $10^{-6}$ torr to match the pressure in the cathode and tube processing chambers 42 and 44. Once the pressure is equalized, the gate valve 54 is opened to allow assembly of the image tube 10.

Although the silicon material of the CCD 12 is relatively gas-free, the CCD 12 may be degassed using ultra-violet energy bombardment as would be known to one skilled in the art.

To assemble the image tube 10, the CCD 12 is placed on the press station 63, directly under the indium ring 36, using the manipulator 58. Subsequently, the cathode assembly 19 is placed on top of the indium ring 28 using the manipulator 60. Manipulators 58 and 60 are preferably magnetically coupled manipulators.

Using sight glass 62, the cathode assembly 19 and CCD 12 can be accurately placed for a proper fit in the housing 26. Once the CCD 12 and cathode assembly 19 are aligned, the jack 66 is extended upward, placing the CCD 12 in contact with the indium ring 36. Continued upward movement of the jack 66 lifts the housing 26 and CCD assembly 19, eventually resulting in contact with the press 68. With the faceplate 20 of the cathode assembly 19 in contact with the press 68, slight upward pressure from the jack 66 will cause a seal to be formed between the CCD assembly 19 and the indium ring 28, and between the CCD 12 and the indium ring 36. The jack 66 is then lowered, and the finished image tube 10 may be removed from the chambers through gates 52 and 54.

The process of the present invention allows the degassing and the photocathode evaporation to be performed prior to placing the CCD 12 in the chamber. Thus, the processes which require a high temperature do not affect the integrity of the CCD 12. Once the temperature returns to room temperature, or another temperature which will not damage the CCD 12, the bonding of the CCD to the frame 32 may be performed, since the indium seal is a cold seal.

Although the description of the present invention assumes that a CCD is used to receive the image from the photocathode, any similar device may be used in place of the CCD, such as charge injected devices (CIDs), or MOS photodiodes.

Although the preferred embodiment of the invention has been described in detail, it should be understood that the various changes, substitutions and alterations can be made therein without departing from the spirit and scope of the invention as defined by the appended claims.

What is claimed is:

1. An apparatus for bonding a photoelectronic device to an image tube housing comprising:

a first chamber for processing the image tube housing;

a second chamber connected to said first chamber such that each chamber can be evacuated independently of the other;

means for heating said first and second chambers;

means for evacuating said first and second chambers; and means for placing the photoelectronic device in contact with the image tube housing to create a seal therebetween at temperatures which will not degrade the photoelectric device.

2. The apparatus of claim 1 and further comprising movable platform means disposed in one of said chambers for placing the photoelectronic device in contact with the image tube housing.

3. The apparatus of claim 1 and further comprising means for manipulating the photoelectronic device and the image tube within said chambers.

4. The apparatus of claim 1 wherein said seal is created by pressing said photoelectronic device against a sealing material disposed on the image tube housing.

5. The apparatus of claim 1 and further comprising means for degassing said image tube housing.

6. The apparatus of claim 5 wherein said degassing means is operable to heat said first chamber to approximately 375° Centigrade for approximately twelve hours at $10^{-9}$ torr.

7. The apparatus of claim 1 and further comprising means for processing a cathode for disposal on the image tube housing.

8. The apparatus of claim 7 wherein said cathode is processed in said first chamber.

9. The apparatus of claim 7 and further comprising means for degassing the cathode.

10. The apparatus of claim 1 wherein said photoelectric device is a CCD.

11. An apparatus for bonding a photoelectric device to an image tube housing comprising:

means for degassing the image tube housing, including means for heating the image tube housing separately from the photoelectric device;

a vacuum chamber for providing an evacuated environment in which to seal said photoelectric device to said image tube housing at a temperature which will not degrade the photoelectric device; and means for transporting the image tube housing and the photoelectric device into said vacuum chamber.

12. An apparatus for bonding a photoelectric device to an image tube housing comprising:

a first vacuum chamber for processing the image tube housing;

means for heating said first vacuum chamber to remove gasses from said first vacuum chamber and the image tube housing;

a second vacuum chamber for containing the photoelectric device at a predetermined pressure;

means for heating said second vacuum chamber prior to placing the photoelectric device therein to remove gasses from said second chamber;

means for equalizing pressure between said first vacuum chamber and said second vacuum chamber at a predetermined pressure and a predetermined temperature at which the photoelectric device will not be damaged;

platform means in said first vacuum chamber operable to place said photoelectric device in contact with said image tube housing; and means for transporting the photoelectric device from said second vacuum chamber to said platform means in said first vacuum chamber.

13. A method of bonding a photoelectronic device to an image tube, comprising the steps of:

processing the housing of the image tube in a first chamber at a high temperature;

heating and evacuating a second chamber operably connectable to said first chamber;

cooling said second chamber to a temperature at which the photoelectronic device will not be damaged;

placing the photoelectronic device in said second chamber after said cooling step;

evacuating said second chamber to a pressure substantially equal to the pressure in said first chamber;

placing the photoelectric device in contact with the image tube housing to create a seal between the image tube housing and the photoelectronic device.

14. The method of claim 13 wherein said second chamber is cooled to approximately room temperature.

15. The method of claim 13 wherein said first chamber is cooled to below 200° Centigrade.

16. The method of claim 13 and further comprising the step of cooling said first chamber.

17. The method of claim 13 wherein said seal creating step comprises:

providing a indium material on the image tube housing; and pressing said photoelectronic device against said indium material.

18. The method of claim 13 wherein said step of processing the housing comprises degassing the housing.

19. The method of claim 18 wherein said degassing step includes heating said first chamber to approximately 375° Centigrade for approximately twelve hours at $10^{-9}$ torr.

20. The method of claim 13 and further comprising the step of processing a cathode for disposal on the housing of the image tube.

21. The method of claim 20 wherein said cathode is processed in said first chamber.

22. The method of claim 20 wherein said cathode is processed in a chamber connected to said first chamber.

23. The method of claim 20 wherein said step of processing the cathode includes evaporating an alkaline material on said cathode.

24. The method of claim 23 wherein said step of processing said cathode further includes degassing the cathode.

* * * * *